US009736901B2

(12) United States Patent
Zhao

(10) Patent No.: US 9,736,901 B2
(45) Date of Patent: Aug. 15, 2017

(54) LED SCANNING ARRAY DRIVER CHIP AND REGULATION METHOD CAPABLE OF SELF-REGULATING BRIGHTNESS LINEAR CHANGE

(71) Applicant: Si-En Technology (Xiamen) Limited, Xiamen (CN)

(72) Inventor: Dongshi Zhao, Xiamen (CN)

(73) Assignee: SI-EN TECHNOLOGY (XIAMEN) LIMITED, Xiamen, Fujian (CN)

( * ) Notice: Subject to any disclaimer, the term of this patent is extended or adjusted under 35 U.S.C. 154(b) by 0 days.

(21) Appl. No.: 15/293,297

(22) Filed: Oct. 14, 2016

(65) Prior Publication Data

US 2017/0111969 A1 Apr. 20, 2017

(30) Foreign Application Priority Data

Oct. 16, 2015 (CN) ..... 2015 1 0667324

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 37/0281* (2013.01)

(58) Field of Classification Search
CPC .... H05B 37/02; H05B 37/0281; H05B 33/08; H05B 33/0815; H05B 33/0845
USPC ..... 315/185 R, 200 R, 209 R, 224–226, 291, 315/307, 308, 312
See application file for complete search history.

(56) References Cited

U.S. PATENT DOCUMENTS 8,305,415 B2 * 11/2012 Ohno ..... B41J 2/45 347/224
2012/0256998 A1 * 10/2012 Inoue ..... B41J 2/45 347/247

* cited by examiner

*Primary Examiner* — Jimmy Vu
(74) *Attorney, Agent, or Firm* — Leong C. Lei

(57) ABSTRACT

An LED scanning array driver chip and a regulation method capable of self-regulating brightness linear change are provided. The LED scanning array driver chip is provided with LED current non-linear automatic control circuits to automatically regulate the average current of LEDs for the brightness of the LEDs to become bright or dark linearly, enabling each LED of the LED array to control the current non-linear change individually. This greatly reduces the time resource for a MCU to write registers inside the driver chip.

4 Claims, 5 Drawing Sheets

LED SCANNING ARRAY DRIVER CHIP AND REGULATION METHOD CAPABLE OF SELF-REGULATING BRIGHTNESS LINEAR CHANGE

BACKGROUND OF THE INVENTION (a) Technical Field of the Invention

The present invention relates to an LED product, and more particularly to an LED scanning array driver chip and a regulation method capable of self-regulating brightness linear change.

(b) Description of the Prior Art

LED arrays are widely used as a man-machine interactive platform in many fields, such as consumer electronics of household appliances, industrial control, automotive electronics, medical equipment, and many other fields.

In some applications, all LEDs of the LED array are in the same color. LEDs are used to display characters, images, the running state of a machine, regulation of parameters and so on. In some applications, the LED array includes red, green and blue LEDs and uses a LED array driver chip to regulate the brightness of the red, green and blue LEDs to form various and adjustable colors. This application using LED array driver chip is a RGB LED. In some applications, the LED array includes both RGB LEDs and common LEDs.

In the system of these applications, LED arrays are usually used as the load of the LED array driver chip (hereinafter referred to the driver chip) to light or extinguish. MCU writes the control information of the LED array into the driver chip via serial communication protocols (the serial communication generally uses I2C, SPI communication, etc.) The driver chip controls the brightness and the current of the LED array according to the commands from MCU.

As shown in FIG. 1, the LED array comprises a plurality of LEDs. Each LED needs to control three basic parameters, a current value, a lighted state, an extinguished state. In specific applications, the brightness linearity of the LED is gradually decreased until it is extinguished. Or in an extinguished state, the brightness linearity is gradually increased unit a certain brightness and this brightness is kept. What is seen is that the LED is slowly darkened from the brighter state and finally it is extinguished, or it is slowly brightened from the extinguished state. The conversion of lighting and extinguishing the LED is not sudden, showing a soft brightness variation.

The linear change of the brightness of this LED is accomplished by changing the current of the LED constantly. The LED array is accomplished by means of scanning. For example, in a classic drive way, a driver chip has N IO buses to drive (N/2)2 LEDs; in an interconnected way, it can drive N (N−1) LEDs. Four IO buses are taken as an example. FIG. 2 shows a classic connection of the LED array. FIG. 3 shows an interconnection of the LED array.

As shown in FIG. 3, the brightness of each of LEDs 1-12 is different. Each LED is able to regulate brightness linearly. LED1 and LED2 are taken as an example to describe the problem that needs to be solved. As shown in FIG. 3, the brightness of the LEDs and the current passing through the LEDs are not a linear relationship, so the current passing through the LEDs is a non-linear change when the LED brightness varies linearly. As shown in FIG. 3, LED1 and LED2 have different brightness and current at the periods of T1 and T8. The brightness at the periods of T2, T3, T6, T7 is regulated linearly, not regulating the current linearly. A method to solve the above problem is that MCU via I2C, SPI or other communications constantly rewrites current control registers or PWM registers in the driver chip to change the current of the LEDs so as to control the brightness change of the LEDs. This will take up a lot of time resources of MCU to write the registers of the driver chip. Accordingly, the inventor of the present invention has devoted himself based on his many years of practical experiences to solve this problem.

SUMMARY OF THE INVENTION

In view of the drawbacks of the prior art, the primary object of the present invention is to provide an LED scanning array driver chip and a regulation method capable of self-regulating brightness linear change. There is no need for MCU to constantly write registers inside a driver chip and to regulate the average current of LEDs for the brightness of the LEDs to become bright or dark linearly. The LED current non-linear automatic control circuits inside the driver chip enable each LED of the LED array to control the current non-linear change individually. This greatly reduces the time resource that the MCU writes the registers inside the driver chip.

According to an aspect of the present invention, an LED (light emitting diode) scanning array driver chip capable of self-regulating brightness linear change is provided and comprises:

a I2C (inter-integrated circuit) series communication interface, consisting of a SCL (serial clock line) and a SDL (serial data line), the I2C serial communication interface being connected with a control register and able to reading/write the control register;

the control register, comprising:

(1) on/off control registers, each LED being provided with an on/off control register for controlling a corresponding one of LEDs to light or extinguish;

(2) PWM (pulse width modulation) registers, each LED being provided with a PWM register for controlling a duty cycle of LED current;

(3) current non-linear automatic regulation selection registers, each LED being provided with a current non-linear automatic regulation selection register for controlling the corresponding LED to select one of current non-linear automatic regulations;

(4) software interrupt registers, the I2C serial communication interface being able to read the software interrupt registers to check which one of current non-linear automatic controls is over;

(5) a synchronous clock control register, controlling three state of a pin, the three states being (a) a high-impedance state; (b) an output state, outputting a square wave signal at a certain frequency, other chips inputting the square wave signal, enabling the LED current non-linear automatic controls of other chips to be synchronized with the chip; (c) an input state, inputting a square wave signal as a clock signal for the chip to drive the LED current non-linear automatic controls;

a synchronous clock control circuit, connected with the control register, for controlling the input state, the output state, and the high-impedance state of the pin of the synchronous clock control register;

LED current non-linear automatic control circuits, connected with the synchronous clock control circuit and the control register, with a current ratio of the current nonlinear automatic regulations of multiple step LEDs; when the PWM register regulates the duty cycle of the LED current, the LED current non-linear automatic control circuits regulate the DC current of the LEDs to achieve a self-regulation of average current of the LEDs, without affecting the function of the PWM to regulate the average current;

an LED scanning timing control circuit, a current source circuit, and an open-drain output circuit, the current source circuit being connected with the LED current non-linear automatic control circuits, the LED scanning timing control circuit being connected with the LED current non-linear automatic control circuits, the open-drain output circuit being connected with the LED scanning timing control circuit.

Preferably, the open-drain output circuit has an output pin as an open-drain output. The chip is externally connected with a pull-up resistor. When the control of any one of the LED current non-linear automatic control circuits is over, the input pin is pulled down to the bottommost to output low-level current.

Preferably, the control register further comprises a state checking register. A MCU (microprogrammed control unit) reads the state checking register to check the current state of any one of the LED current non-linear automatic controls.

According to another aspect of the present invention, a brightness linear change self-regulation method of an LED (light emitting diode) scanning array driver chip is provided and comprising the steps of: a MCU (microprogrammed control unit) reading/writing a control register through a I2C serial communication interface, the control register comprising an on/off control register, a PWM register, a current non-linear automatic regulation selection register, a software interrupt register, and a synchronous clock control register for each LED, the on/off control register controlling a corresponding one of LEDs to light or extinguish, the PWM register controlling a duty cycle of the corresponding LED, the current non-linear automatic regulation selection register being controlled by LED current non-linear automatic control circuits for controlling the corresponding LED to select one of the current non-linear automatic for controls, while the PWM register regulates the duty cycle of the LED current, the LED current non-linear automatic control circuits cooperating with the current non-linear automatic regulation selection register to regulate the DC current of the LEDs to achieve a self-regulation of average current of the LEDs, without affecting the function of the PWM to regulate the average current; the I2C serial communication interface reading the software interrupt register to check which one of current non-linear automatic controls is over, the synchronous clock control register being controlled by a synchronous clock control circuit, the chip having an input state, an output state and a high-impedance state, wherein when in the output state, a pin of the synchronous clock control register outputs a square wave signal and other chips input the square wave signal, enabling the LED current non-linear automatic controls of the other chips to be synchronized with the chip; when in the output state, the pin of the synchronous clock control register inputs a square wave signal as a clock signal for the chip to drive the LED current non-linear automatic controls.

Compared to the prior art, the present invention has obvious advantages and beneficial effects. The LED scanning array driver chip is provided with the LED current non-linear automatic control circuits. While the duty cycle of the LED current is regulated by the PWM register, the LED current non-linear automatic control circuits cooperates with the current non-linear automatic regulation selection register to regulate the DC current of the LEDs to achieve a self-regulation of average current of the LEDs, without affecting the function of the PWM to regulate the average current. There is no need for the MCU to constantly write the registers inside the driver chip and to regulate the average current of the LEDs for the brightness of the LEDs to become bright or dark linearly. The LED current non-linear automatic control circuits inside the driver chip enable each LED of the LED array to control the current non-linear change individually. This greatly reduces the time resource for the MCU to write the registers inside the driver chip.

DETAILED DESCRIPTION OF THE PREFERRED EMBODIMENTS

Figure 1:
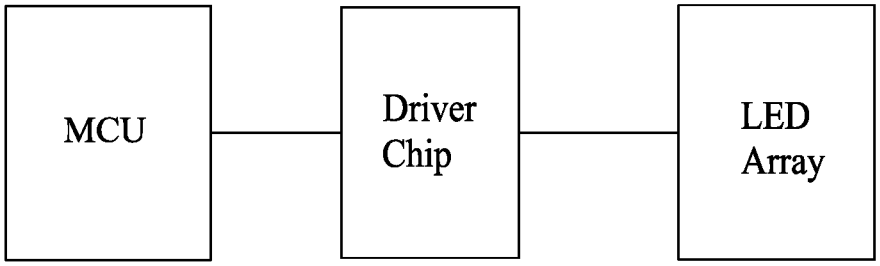
FIG. 1 is block diagram of a conventional LED array.

Embodiments of the present invention will now be described, by way of example only, with reference to the accompanying drawings.

As shown in FIG. 4 to FIG. 7, a preferred embodiment of the present invention discloses an LED scanning array driver chip and a regulation method capable of self-regulating brightness linear change. The brightness of each LED at T1, T8 time periods can be adjusted to be different. Each LED can separately control the brightness linear change of each LED to become dark or bright so as to greatly reduce the time resource for a MCU (microcontroller unit) writes the registers of the driver chip.

The present invention describes the LED array driver chip. The driver chip drives the LED array by means of scanning. The system of the LED array driver chip comprises the following techniques:

PWM control: The driver chip is provided with a PWM register for each LED to separately control the duty cycle of the current of each LED. The PWM register controls the average current of LEDs.

DC current control: The driver chip is provided with a plurality of LED current non-linear automatic control circuits 40. The MCU sets the related parameters of each LED current non-linear automatic control circuit 40 via a communication mode, such as I2C (Inter-Integrated Circuit). Meanwhile, the DC current of each LED can be set to be synchronized with the current controlled by any one of the LED current non-linear automatic control circuits 40, or the DC current is set to be a constant value. The related parameters of each LED current non-linear automatic control circuit 40 include gradually brighter time T1; the brightest time T2; gradually darker time T3; a completely dark time T4; a start time T_START; an end time T_END; and the frequency of circulation N.

Hardware interrupt output: The driver chip is provided with a hardware interrupt output pin INTB. The INTB pin is an open-drain output. The chip is externally connected with a pull-up resistor. Its function is that when the control of any one of the LED current non-linear automatic control circuits 40 is over, the INTB pin is pulled down to the bottommost to output low-level current.

Software interrupt register: Each LED current non-linear automatic control circuit 40 has a software interrupt register R_INTx. When one of the LED current non-linear automatic controls is over, R_INTx becomes 1. The MCU reads the interrupt register through a series communication protocol. This can know which one of the LED current non-linear automatic controls is over. After reading, the content of the interrupt register is automatically cleared.

Synchronous function: The driver chip is provided with a synchronous clock signal input and output pin SYN. The frequency of the synchronous clock signal is 32.768 Khz. This signal is used to synchronize the timings of the LED current non-linear automatic controls of different driver chips. The driver chip is provided with two synchronous clock control registers SYNC. When SYNC=00 or 11. The SYN pin is in a high-impedance state; when SYNC=01, SYN outputs a 32.768 Khz square wave signal and the other chips input the square wave signal, enabling the LED current non-linear automatic controls of the other chips to be synchronized with the chip; When SYNC=10, SYN inputs a square wave signal as the clock signal for the chip to drive the LED current non-linear automatic controls.

State checking register: The driver chip is provided with a state checking register. MCU reads the state checking register to check the current state of any one of the LED current non-linear automatic controls.

Figure 2:
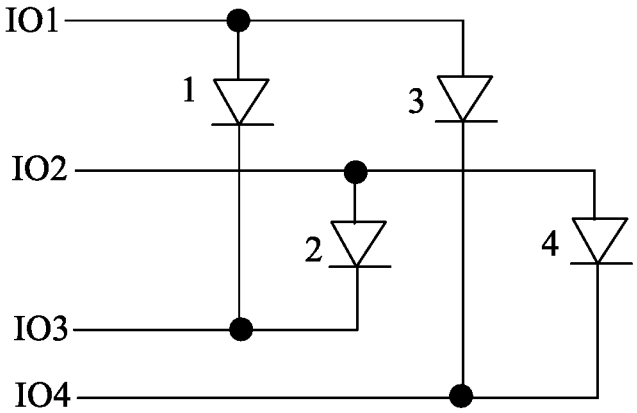
FIG. 2 shows a classic connection of the LED array.
Figure 3:
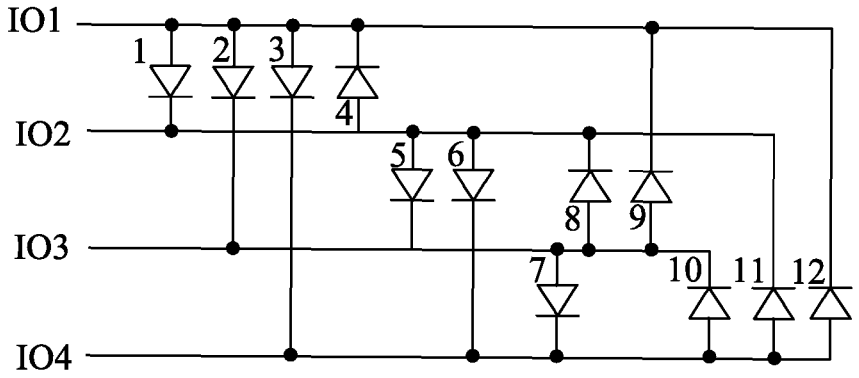
FIG. 3 shows an interconnection of the LED array.
Figure 4:
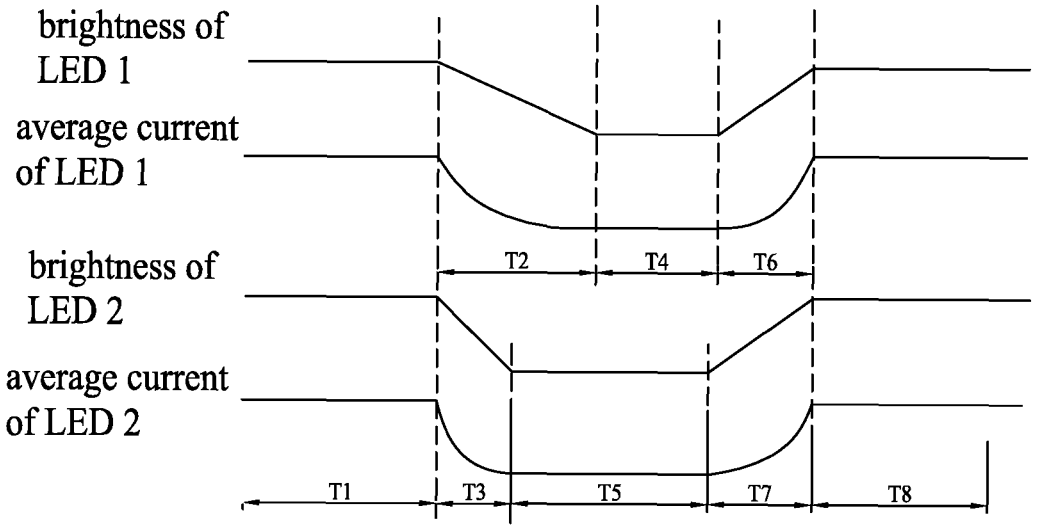
FIG. 4 is a schematic view showing the brightness change and the current change of LEDs.
Figure 5:
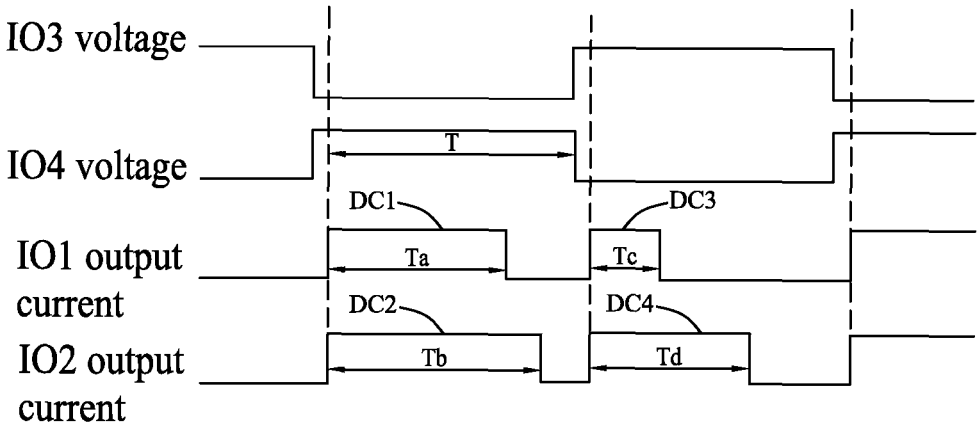
FIG. 5 is a schematic view showing the scanning timing of the classic connection of the LED array according to a preferred embodiment of the present invention.
Figure 6:
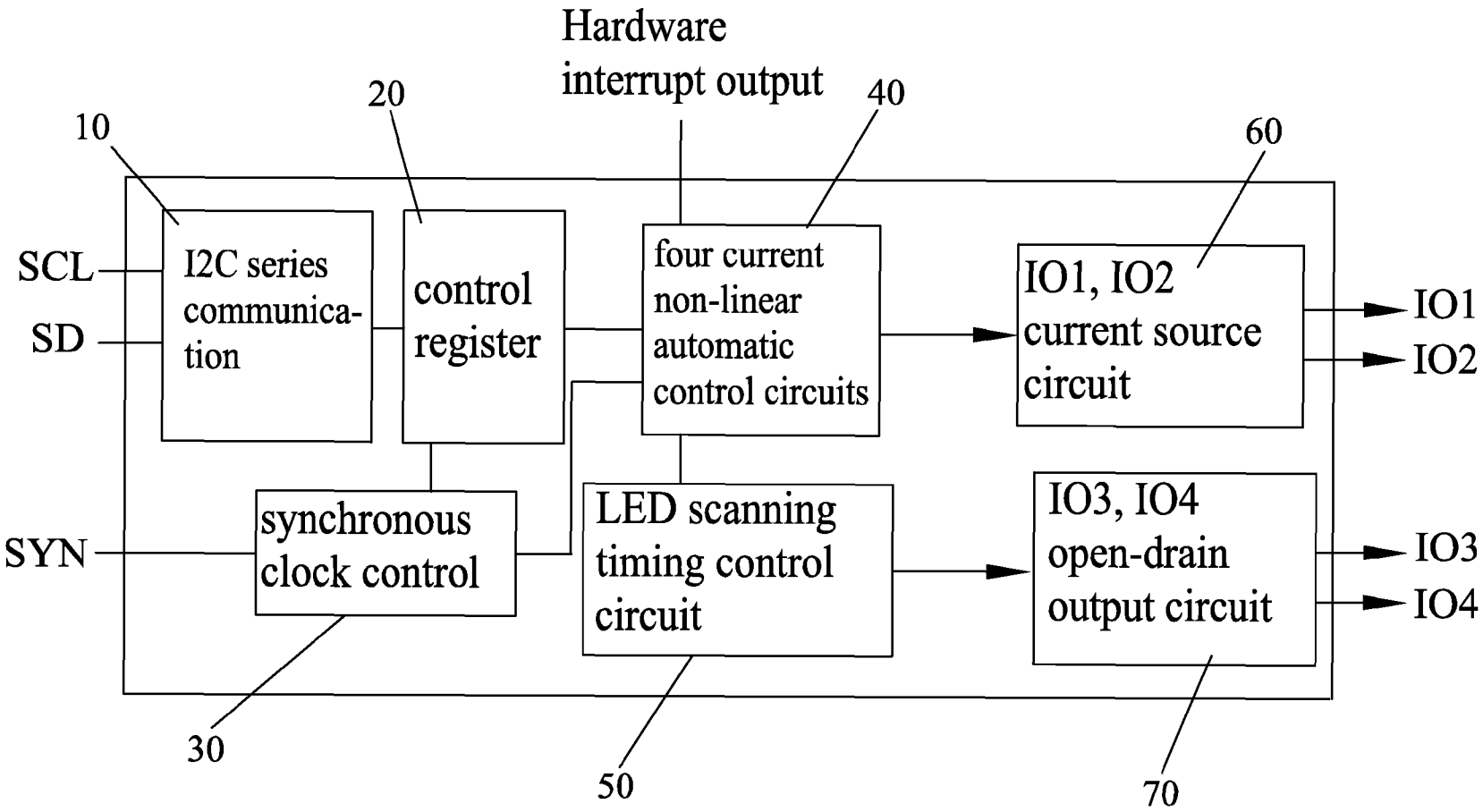
FIG. 6 is a block diagram showing the system according to the preferred embodiment of the present invention.

The working principle of the present invention is illustrated with the LED array classic connection shown in FIG. 2 as an example. FIG. 5 shows the scanning timing of the LED array classic connection, I01 and I02 output currents DC1=DC2=DC3=DC4. The length of time Ta is changed to change the duty cycle of the current of LED1 and further to change the average current of LED1 Similarly, the lengths of time Tb, Tc, Td are changed to adjust the average current of LED2, LED3, LED4, respectively. On this basis, it increases the control of DC1, DC2, DC3, DC4. As shown in FIG. 6, the LED current non-linear automatic control circuits 40 are provided. While the duty cycle of the LED current is regulated, the DC current of the LED is also regulated to achieve an automatic regulation of the average current of the LED, without affecting the function of PWM to regulate the average current.

FIG. 6 is a block diagram showing the system structure of the LED scanning array driver chip corresponding to the circuit of FIG. 2. The system structure comprises a I2C series communication interface 10, a control register 20, a synchronous clock control circuit 30, current non-linear automatic control circuits 40, a LED scanning timing control circuit 50, I01, I02 current source circuit 60, and I03, I04 open-drain output circuit 70. The I2C serial communication interface 10, the synchronous clock control circuit 30 and the current non-linear automatic control circuit 40 are connected with the control register 20, respectively. The synchronous clock control circuit 30, the LED scanning timing control circuit 50, and the current source circuit 60 are connected with the current non-linear automatic control circuit 40, respectively. The open-drain output circuit 70 is connected with the LED scanning timing control circuit 50.

Specifically, the I2C serial communication interface 10 consists of a serial clock line (SCL) and a serial data line (SDL). The I2C serial communication interface 10 can read/write the control register 20.

The control register 20 comprises:

(1) on/off control registers ON/OFF1-4 for LED1-4: each LED is provided with an on/off control register for controlling the corresponding LED to light or extinguish. For example, ON/OFF3=0, no matter how much is the duty cycle of LED3 and the PWM3 register, the state of LED3 is off and the current is zero;

(2) PWM registers PWM1-4: each LED is provided with a PWM register for controlling the duty cycle of the corresponding LED, PWM1-4 control the duty cycle of the current of LED1-4;

(3) Current non-linear automatic regulation selection registers AU1-4: each LED is provided with a current non-linear automatic regulation selection register for controlling the corresponding LED to select which one of the current non-linear automatic regulations;

For example, the current non-linear automatic regulation selection register corresponding to LED2 is AU2 and set 3 bits. If AU2=001, LED2 selects the first current nonlinear automatic control circuit 40. The first current nonlinear automatic control circuit 40 includes seven control registers, T1_1, T2_1, T3_1, T4_2, T_START_1, T_END_1, N_1. If AU1=011, LED1 selects the third current nonlinear automatic control circuit. The third current nonlinear automatic control circuit includes T1_3, T2_3, T3_3, T4_3, T_START_3, T_END_3, N_3 control registers. AU1-4 can be set with the same value, such as 100. The DC currents of four LEDs are all regulated by the fourth current nonlinear automatic control circuit. If AUX is not set at the value of 001, 010, 011, 100, the DC current of LEDX is a constant value. The related parameters of the current nonlinear automatic control circuits of our LEDs are T1_1-4, T2_1-4, T3_1-4, T4_1-4, T_START_1-4, T_END_1-4, N_1-4. The current nonlinear automatic control circuit of each LED includes seven parameters.

(4) Software interrupt registers R_INT1, R_INT2, R_INT3, R_INT4: I2C can read this register to check which one of the current non-linear automatic controls is over.

(5) Synchronous clock control register SYNC: when SYNC=00 or 11, SYN pin is in a high-impedance state; when SYNC=01, SYN outputs a 32.768 Khz square wave signal and the other chips input the square wave signal, enabling the LED current non-linear automatic controls of the other chips to be synchronized with the chip; when SYNC=10, SYN inputs a square wave signal as the clock signal for the chip to drive the LED current non-linear automatic controls.

The synchronous clock control circuit 30 controls the three states of the SYN pin of the synchronous clock control register, namely, an input state, an output state, and a high-impedance state.

Figure 7:
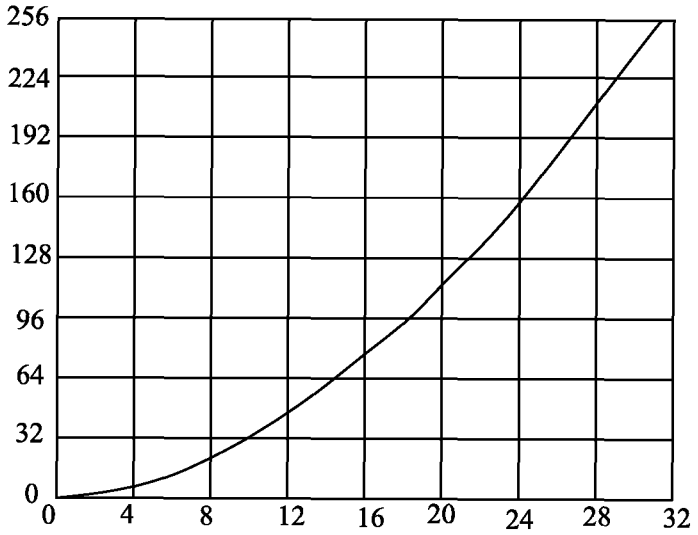
FIG. 7 is a view showing the current ratio of LED current nonlinear automatic regulations according to the preferred embodiment of the present invention.

Four current nonlinear automatic control circuits 40 are provided. Table 1 shows the current ratio of the current nonlinear automatic regulations of 32 step LEDs. FIG. 7 is a chart showing the current ratio of the LED current non-linear automatic regulations. The horizontal axis is the amount of time or the step number. The ordinate is the DC current value of the corresponding LED.

C (0) denotes the 0 step LED, the DC current is 0; C (1) denotes the first step LED, the DC current is 1; C (x) denotes the DC current value of the LED corresponding to the x step, as shown in Table 1.

TABLE 1

| the current ratio of the current nonlinear automatic regulations of 32 step LEDs | | | | | | | |
|---|---|---|---|---|---|---|---|
| C(0) | C(1) | C(2) | C(3) | C(4) | C(5) | C(6) | C(7) |
| 0 | 1 | 2 | 4 | 6 | 10 | 13 | 18 |
| C(8) | C(9) | C(10) | C(11) | C(12) | C(13) | C(14) | C(15) |
| 22 | 28 | 33 | 39 | 46 | 53 | 61 | 69 |
| C(16) | C(17) | C(18) | C(19) | C(20) | C(21) | C(22) | C(23) |
| 78 | 86 | 96 | 106 | 116 | 126 | 138 | 149 |
| C(24) | C(25) | C(26) | C(27) | C(28) | C(29) | C(30) | C(31) |
| 161 | 173 | 186 | 199 | 212 | 226 | 240 | 255 |

The LED scanning timing control circuit 50, the current source circuit 60, and the open-drain output circuit 70 are common circuits existing this field, so they won't be described in detail.

The control principle of the present invention is described hereinafter. The MCU reads/writes the control register 20 through the I2C serial communication interface 10. The control register 20 comprises the on/off control register, the PWM register, the current non-linear automatic regulation selection register, the software interrupt register, and the synchronous clock control register for each LED. The on/off control register controls the corresponding LED to light or extinguish. The PWM register controls the duty cycle of the corresponding LED. The current non-linear automatic regulation selection register is controlled by the LED current non-linear automatic control circuits 40 for controlling the corresponding LED to select which one of the current non-linear automatic regulations. While the PWM register regulates the duty cycle of the LED current, the LED current non-linear automatic control circuits 40 cooperates with the current non-linear automatic regulation selection register to regulate the DC current of the LED to achieve a self-regulation of the average current of the LED, without affecting the function of the PWM to regulate the average current. The I2C serial communication interface reads the software interrupt register to check which one of the current non-linear automatic controls is over. The synchronous clock control register is controlled by the synchronous clock control circuit 30. The chip has three states, namely, an input state, an output state and a high-impedance state. When in the output state, the pin of the synchronous clock control register outputs a square wave signal and the other chips input the square wave signal, enabling the LED current non-linear automatic controls of the other chips to be synchronized with the chip. When in the output state, the pin of the synchronous clock control register inputs a square wave signal as the clock signal for the chip to drive the LED current non-linear automatic control.

Accordingly, the feature of the present invention is that the LED scanning array driver chip capable of self-regulating brightness linear change is added with the LED current non-linear automatic control circuits 40. While the duty cycle of the current of the LED is regulated, the DC current of the LED is also regulated to achieve an automatic regulation of the average current of the LED, without affecting the function of the PWM to regulate the average current. There is no need for MCU to constantly write the registers inside the driver chip and to regulate the average current of the LEDs for the brightness of the LEDs to become bright or dark linearly. The LED current non-linear automatic control circuits inside the driver chip enable each LED of the LED array to control the current non-linear change individually. This greatly reduces the time resource for the MCU to write the registers inside the driver chip.

Although particular embodiments of the present invention have been described in detail for purposes of illustration, various modifications and enhancements may be made without departing from the spirit and scope of the present invention. Accordingly, the present invention is not to be limited except as by the appended claims.

I claim:

1. An LED (light emitting diode) scanning array driver chip capable of self-regulating brightness linear change, comprising:

a I2C (inter-integrated circuit) series communication interface, consisting of a SCL (serial clock line) and a SDL (serial data line), the I2C serial communication interface being connected with a control register and able to read/write the control register;

the control register, comprising (1) on/off control registers, each LED being provided with an on/off control register for controlling a corresponding one of LEDs to light or extinguish; (2) PWM (pulse width modulation) registers, each LED being provided with a PWM register for controlling a duty cycle of LED current; (3) current non-linear automatic regulation selection registers, each LED being provided with a current non-linear automatic regulation selection register for controlling the corresponding LED to select one of current non-linear automatic regulations; (4) software interrupt registers, the I2C serial communication interface being able to read the software interrupt registers to check which one of current non-linear automatic controls is over; (5) a synchronous clock control register, controlling three state of a pin, the three states being (a) a high-impedance state; (b) an output state, outputting a square wave signal at a certain frequency, other chips inputting the square wave signal, enabling the LED current non-linear automatic controls of other chips to be synchronized with the chip; (c) an input state, inputting a square wave signal as a clock signal for the chip to drive the LED current non-linear automatic controls;

a synchronous clock control circuit, connected with the control register, for controlling the input state, the output state, and the high-impedance state of the pin of the synchronous clock control register;

LED current non-linear automatic control circuits, connected with the synchronous clock control circuit and the control register, with a current ratio of the current nonlinear automatic regulations of multiple step LEDs, when the PWM register regulates the duty cycle of the LED current, the LED current non-linear automatic control circuits regulate the DC current of the LEDs to achieve a self-regulation of average current of the LEDs, without affecting the function of the PWM to regulate the average current;

an LED scanning timing control circuit, a current source circuit, and an open-drain output circuit, the current source circuit and the LED scanning timing control circuit being connected with the LED current non-linear automatic control circuits, the open-drain output circuit being connected with the LED scanning timing control circuit.

2. The LED scanning array driver chip capable of self-regulating brightness linear change as claimed in claim 1, wherein the open-drain output circuit has an output pin which is an open-drain output, the chip is externally connected with a pull-up resistor, when the control of any one of the LED current non-linear automatic control circuits is over, the input pin is pulled down to the bottommost to output low-level current.

3. The LED scanning array driver chip capable of self-regulating brightness linear change as claimed in claim 1, wherein the control register further comprises a state checking register, and a MCU (microprogrammed control unit) reads the state checking register to check the current state of any one of the LED current non-linear automatic controls.

4. A brightness linear change self-regulation method of an LED (light emitting diode) scanning array driver chip, comprising the steps of: a MCU (microprogrammed control unit) reading/writing a control register through a I2C serial communication interface, the control register comprising an on/off control register, a PWM register, a current non-linear automatic regulation selection register, a software interrupt register, and a synchronous clock control register for each LED, the on/off control register controlling a corresponding one of LEDs to light or extinguish, the PWM register controlling a duty cycle of the corresponding LED, the current non-linear automatic regulation selection register being controlled by LED current non-linear automatic control circuits for controlling the corresponding LED to select which one of the current non-linear automatic for controls, while the PWM register regulates the duty cycle of the LED current, the LED current non-linear automatic control circuits cooperating with the current non-linear automatic regulation selection register to regulate the DC current of the LEDs to achieve a self-regulation of average current of the LEDs, without affecting the function of the PWM to regulate the average current; the I2C serial communication interface reading the software interrupt register to check which one of the current non-linear automatic controls is over, the synchronous clock control register being controlled by a synchronous clock control circuit, the chip having an input state, an output state and a high-impedance state, wherein when in the output state, a pin of the synchronous clock control register outputs a square wave signal and other chips input the square wave signal, enabling the LED current non-linear automatic controls of the other chips to be synchronized with the chip; when in the output state, the pin of the synchronous clock control register inputs a square wave signal as a clock signal for the chip to drive the LED current non-linear automatic controls.

* * * * *